US005622313A

United States Patent [19]

Lader et al.

[11] Patent Number: 5,622,313

[45] Date of Patent: Apr. 22, 1997

[54] TRIBOELECTRIC POWDER SPRAY GUN WITH INTERNAL DISCHARGE ELECTRODE AND METHOD OF POWDER COATING

[75] Inventors: Harry J. Lader, Lakewood; William R. Rehman, Vermillion; James W. Messerly, Stow, all of Ohio

[73] Assignee: Nordson Corporation, Westlake, Ohio

[21] Appl. No.: 398,376

[22] Filed: Mar. 3, 1995

[51] Int. Cl.[6] ..... B05B 5/047

[52] U.S. Cl. ..... 239/3; 239/704; 239/706; 239/692

[58] Field of Search ..... 239/3, 692, 706, 239/704

[56] References Cited

U.S. PATENT DOCUMENTS

| | | | |
|---|---|---|---|
| 3,905,330 | 9/1975 | Coffe | 239/3 |
| 3,991,710 | 11/1976 | Gourdine et al. | 239/692 X |
| 4,359,192 | 11/1982 | Takahashi et al. | 239/692 |
| 4,659,019 | 4/1987 | Talacko . | |
| 4,706,890 | 11/1987 | Talacko . | |
| 4,747,546 | 5/1988 | Talacko . | |
| 4,784,331 | 11/1988 | Sharpless et al. . | |
| 4,798,340 | 1/1989 | Vöhringer et al. . | |
| 4,830,279 | 5/1989 | Crum et al. . | |
| 4,979,680 | 12/1990 | Bauch et al. . | |
| 5,056,720 | 10/1991 | Crum et al. . | |

OTHER PUBLICATIONS

John F. Hughes, "Electrostatic Powder Coating," pp. 73–77, 92–93, 106.

*Primary Examiner*—Kevin Weldon
*Attorney, Agent, or Firm*—Rankin, Hill, Lewis & Clark

[57] ABSTRACT

In a triboelectric powder spray gun in which a charge is imparted to the powder triboelectrically by repeated impacts of the powder with contact surfaces, the charging effectiveness of the gun is enhanced by using an electrode to produce corona treatment of the contact surfaces. The corona treatments discharge the contact surfaces and eliminate the need for adjacent grounds with the powder flow path.

11 Claims, 1 Drawing Sheet

TRIBOELECTRIC POWDER SPRAY GUN WITH INTERNAL DISCHARGE ELECTRODE AND METHOD OF POWDER COATING

BACKGROUND OF THE INVENTION

1. Field of the Invention

This invention relates to electrostatic powder coating systems, and more particularly, to the triboelectric charging of powder material for use in powder spraying systems.

2. Description of the Prior Art

In electrostatic powder spraying, particulate powder material is fluidized in a powder hopper and pumped through a hose to a spray gun which electrically charges the powder and sprays the powder onto a product to be coated. The powder particles sprayed from the gun are electrostatically attracted to the product being coated which is generally electrically grounded. Once these electrostatically charged powder particles are deposited onto the product, they adhere there by electrostatic attraction until the product is conveyed into an oven where the powder particles are melted to flow together to form a continuous coating on the product.

The spray gun typically charges the powder in one of two ways-either the gun has a high voltage charging electrode which produces a corona to charge the powder, or the gun has means to charge the powder by friction, i.e., triboelectrically. This invention relates to triboelectric powder spray guns.

Generally, in triboelectric powder guns contact surfaces are provided within the gun, typically constructed from an electrically insulating material, such as polytetrafluoroethylene (PTFE) or nylon, and the powder particles impact these surfaces numerous times to frictionally charge the particles. The powder particles are then sprayed from the front of the gun, where they are electrostatically attracted to the product to be coated which has been electrically grounded.

Triboelectric powder spray guns may be used to produce either a positive or negative charge on the powder depending upon the material being sprayed. The tribocharging preferences of certain materials are well known. For example, polytetrafluoroethylene (PTFE) and nylon have well known tribocharging tendencies which represent tribocharging extremes, with PTFE exhibiting strong negative tribocharging properties and nylon exhibiting strong positive tribocharging properties. Materials that exhibit a strong positive charging tendency and a weak negative charging tendency, such as nylon and some epoxy materials, are used as powder materials in a positive triboelectric spraying system. Materials that exhibit a strong negative charging tendency and a weak positive charging tendency, such as PTFE and some polyester materials, are used as powder in a negative tribocharging spraying system.

Materials which would be used as powders in a positive triboelectric spraying system can be used as contact surfaces in a negative triboelectric spraying system and vice versa. Thus materials that exhibit a strong negative charging tendency, such as PTFE, are used as contact surfaces in a positive triboelectric spraying system, and materials that exhibit a strong positive charging tendency, such as nylon, are used as contact surfaces in a negative tribocharging spraying system.

Various designs for triboelectric spray guns are known, such as those shown in U.S. Pat. No. 4,399,945 and application Ser. No. 07/956,615. These guns and other similar guns are also commercially available, such as the guns available as Tribomatic® guns from Nordson Corporation, Amherst, Ohio. In these guns, the powder can be triboelecrically charged in various ways, such as in a bundle of curved PTFE tubes which are wrapped around a core, or through a wavy undulating path formed in an annular gap between an outer cylinder and a central core each having PTFE contact surfaces. As the powder passes through the flow path, it impacts the contact surfaces several times and picks up charge upon each contact. The contact surfaces are provided with a ground path to bleed the charge on the surfaces to ground and avoid a buildup of charge on the contact surfaces during operation of the gun. In addition, grounding of the gun is needed for reasons of safety to prevent the gun from storing a capacitive charge which could shock an operator or produce a spark, causing a fire or explosion.

In normal tribocharging with a positive tribocharging powder, such as many epoxy materials, the powder impacts the contact surface made of a material such as PTFE. As the powder becomes tribocharged, it gives up electrons to the PTFE, and the powder becomes positively charged. When the concentration of negative charges builds up on the PTFE contact surface to a certain level, the negative charges find the nearest ground to discharge the electron buildup. If the electrons cannot be discharged, the tribocharging process is disrupted, and no additional powder can be charged.

In order to facilitate the discharge of electrons from the contact surface, it has always been important to provide an effective grounding path in triboelectric powder spray guns. Various solutions to providing an effective grounding path have been proposed. However, all of these solutions must prevent inadvertent grounding of the powder, either through buildup of powder around the ground or through direct grounding of the contact surfaces themselves. Ground paths must, therefore, be somewhat complicated, and grounding of prior art guns sometimes involves time-consuming and complicated manufacturing processes.

SUMMARY OF THE INVENTION

The present invention provides a unique and effective method and apparatus for enhancing the charging capabilities of triboelectric powder spray guns by using corona treatments of the contact surfaces. These corona treatments effectively discharge the charge that has built up on the contact surfaces and eliminate the need for adjacent ground references in or near to the powder flow path.

The present invention reduces the possibilities of ineffective charging which can occur if the contact surfaces do not discharge to ground properly. By providing an effective means of discharging the contact surfaces without reliance upon a grounding path, the surfaces can be readily discharged as necessary, and the tribocharging process is not disrupted due a buildup of charge on the contact surfaces.

The present invention enhances the charging of the powder by the contact surfaces in a triboelectric spray gun by allowing the powder to exchange charge of the correct polarity from the contact surfaces and by discharging the negative charge buildup (in the case of positive tribocharging) or positive buildup (in the case of negative tribocharging) on the contact surfaces. In accordance with this invention, an electrode produces a corona which provides ions of the opposite polarity to the tribocharging at appropriate times during the tribocharging. The corona electrode ionizes the air around it and provides ions of either positive or negative polarity (depending upon the polarity of the tribocharging) which ions migrate to points of opposite polarity on the contact surfaces to effectively neutralize the charge buildup.

Unlike the internally charged guns of the prior art, the present invention does not require adjacent grounds. Because the corona treatment effectively discharges the contact surfaces, it is not necessary to provide a ground electrode or other means for discharging or grounding the contact surfaces. This eliminates the problems inherent in providing a ground path within the powder flow path of the gun, such as the buildup of powder around the ground, the reliance upon surface conduction to bleed charge from the surfaces to an adjacent ground, and associated manufacturing and design intricacies.

The corona treatment can be any of three types: (1) Corona can be used to treat the contact surfaces at a relatively high voltage, e.g., positive or negative 100 KV, while the powder is not flowing through the gun. (2) Corona can be used to treat the contact surfaces while the powder is flowing, but at a lower voltage to continuously discharge the contact surfaces. (3) The corona can be pulsed at specific time intervals whether or not powder is flowing.

In the first type treatment above, the corona can be turned on intermittently such as between parts being coated, so that the operation of the powder spray gun is not otherwise affected. Alternatively, the powder and corona can be pulsed out-of-phase, for example, in intervals from under one second to several seconds, such that, when the powder is pulsed "off," the corona is pulsed "on." In this way, the tribocharging process can continue indefinitely since charge buildup on the contact surfaces will not occur. Alternatively, the corona can be pulsed while the powder is being sprayed, for example, in intervals of from under one second to several seconds.

The corona pretreatment of the present invention will not result in excess ions which are detrimental to the coating since the majority of the ions will be used to discharge the contact surfaces and will not be used to charge the powder. In conventional corona charging guns, only about 0.5% of the ions are used to actually charge the powder, while the remaining 99.5% are attracted to the part and result in back ionization which can disrupt the coating by spark discharge and can lead to an "orange peel" effect which is detrimental to the coating appearance. In addition, back-ionization at the part can produce ions of opposite polarity which are attracted back to the gun and which tend to discharge the incoming powder. With the present invention, excess free ions, which may interfere with the appearance and integrity of the coating, are not produced.

The corona treatments according to the present invention also enhance the tribocharging effect of the gun immediately after each pretreatment. The corona treatment deposits ions on the surfaces of the powder flow path, and these ions are accepted by the powder during tribocharging in addition to the normal tribocharging effect.

These and other advantages are provided by the present invention of a method of electrostatic spraying of powder material comprising the steps of flowing the powder material through a spray gun, triboelectrically charging the powder material to a polarity in the spray gun by impacting the powder material with contact surfaces within the gun, and treating the contact surfaces with a corona of said polarity.

In accordance with the apparatus of the present invention, a triboelectric powder spray gun is provided which comprises a feed portion for supplying powder to the gun and for mixing powder with a conveying gas and a charging portion downstream of the feed portion. The charging portion includes contact surfaces for triboelectrically charging the powder as it flows therethrough. The contact surfaces are each made of electrically insulating material, whereby the powder is frictionally charged by repeated contact with the contact surfaces. An electrode produces ions that are deposited on the contact surfaces to discharge them.

DETAILED DESCRIPTION OF THE PREFERRED EMBODIMENT

Figure 1:
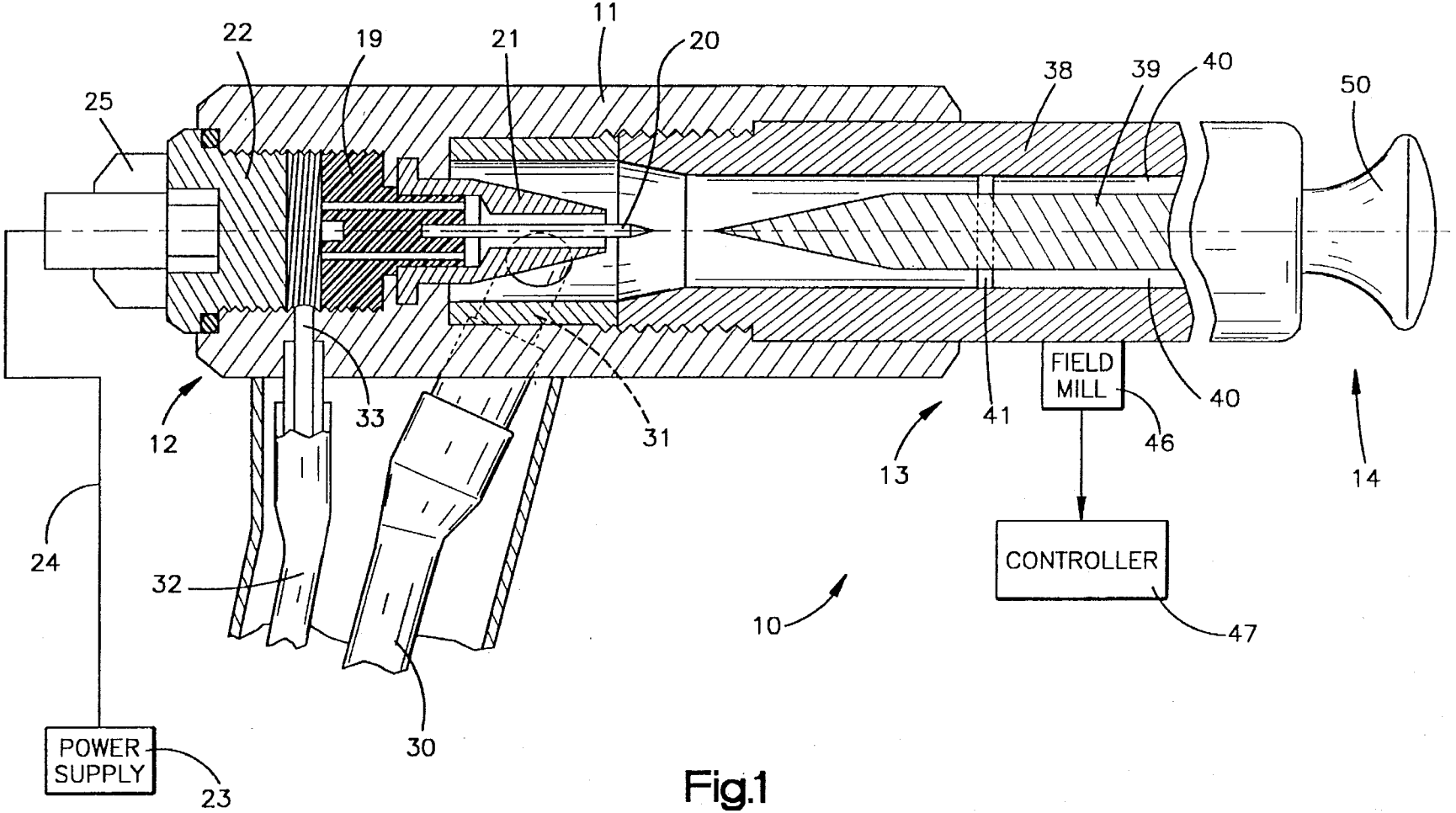
FIG. 1 is a side sectional view of a powder spray gun for use with the method and apparatus of the present invention.

Referring more particularly to the drawings and initially to FIG. 1, there is shown a triboelectric powder spray gun 10 for use with the method and apparatus of the present invention. The gun 10 includes a gun body 11 having a central opening extending therethrough. The body 11 may be manufactured of either an electrically insulating or a conductive material. A suitable gun mount assembly may be attached to the gun body 11 by known means. The gun 10 comprises a feed portion 12 at the inlet or rear end of the gun (to the left as shown in FIG. 1), a charging portion 13 in the middle of the gun, and a sprayhead portion 14 at the outlet or forward end of the gun (to the right as shown in 4 FIG. 1).

The rear end of the central opening through the gun body 11 is threaded, and an electrode holder 19 with a needle-shaped induction electrode 20 mounted thereon are inserted in the end of the threaded portion. As is more fully explained below, the electrode 20 is not used for charging the powder directly but is used for treating the surfaces of the charging portion 13 with a corona to enhance triboelectric charging of the powder. Much of the electrode 20 is covered by an insulating sheath 21. The open rear end of the central opening is covered by a plug 22. The electrode 20 is connected to a suitable power supply 23 by means of a power cord 24 which extends through the plug 22 and through a cord retainer 25 provided on the end of the plug.

Powder from a hopper is conveyed to the gun by flow air from a pump such as that shown in U.S. Pat. No. 4,615,649. The powder and conveying air from the pump enter the gun through a feed hose 30 which is connected to a supply channel 31 extending diagonally to the gun body 11. A supply of compressed gas, usually air, is fed to the gun from a gun control module (not shown) through a gas hose 32 which is connected through a radial channel 33 to the central opening in the gun body 11 between the plug 22 and the electrode 20. The gas then travels through boreholes in the electrode holder 19 and through an annular channel between the electrode 20 and the sheath 21 and into the flow channel of the charging portion 13 of the gun. The gas washes around the electrode 20 and thus prevents powder sintering onto the electrode.

The charging portion 13 of the gun comprises a hollow outer cylinder 38 mounted in the forward end of the central opening in the gun body 11. A portion of the forward end of the central opening is threaded for mounting the outer cylinder 38. An inner core 39 is positioned concentrically within the outer cylinder 38, providing an annular charging path 40 for the powder flowing through the charging portion of the gun. Suitable spacer means such as the spacer element 41 are provided between the outer cylinder 38 and the inner core 39 to maintain the core in proper axial position in the middle of the cylinder. The outer cylinder 38 and the inner core 39 are formed of a suitable electrically insulating material, such as PTFE, which has good triboelectric charging properties.

The charging portion 13 of the gun is provided with a sensor, such as a field mill 46, which measures the buildup of excess charge on the contact surfaces. The field mill 46 is connected to a controller 47 and is used to trigger the corona treatment of the contact surfaces, as will be more fully explained below.

Powder enters the charging portion 13 of the gun from the feed portion 12 and is channelled into the annular charging path 40 between the inner core 39 and the outer cylinder 38 from which the powder is discharged into the sprayhead portion 14.

The outlet end of the charging portion 13 of the gun is designed to accept various conventional sprayheads. As shown, the sprayhead portion 14 comprises a conventional sprayhead 50 which is shown to illustrate the mounting of a sprayhead to the outlet end of the charging portion 13.

In accordance with the present invention, the electrode 20 is used to provide a corona pretreatment to the surfaces of the charging portion 13 of the gun. The corona pretreatment enhances the charging of the powder by allowing the powder to exchange charge of the correct polarity from the contact surfaces of the charging portion 13 and also discharge the charge buildup on the contact surfaces. This charge buildup may be either negative charge buildup in the case of positive tribocharging or positive buildup in the case of negative tribocharging.

At appropriate times during tribocharging, the electrode 20 is energized to provide a corona discharge which produces ions of the opposite polarity to tribocharging. For example, in a normal tribocharging system with a positive tribocharging powder such as epoxy, the contact surfaces of the charging portion 13 are made of PTFE which has strong negative tribocharging characteristics. A positive charge is applied to the epoxy powder by the PTFE contact surfaces, leaving the PTFE contact surfaces with a negative charge. The electrode 20 is charged to a positive voltage to produce positive ions which are applied to the contact surfaces to discharge the negative charge on the surfaces. The corona electrode 20 thus ionizes the air around it and provides ions of either positive or negative polarity (depending upon the charge triboelectrically imparted to the powder) which ions migrate to points of opposite polarity on the contact surfaces to effectively neutralize the charge buildup.

The pretreatment can be applied using any of various procedures. One procedure is to pretreat the contact surfaces at a relatively high voltage, e.g., positive or negative 100 KV, at a time while the powder is not flowing through the gun. The corona can be turned on intermittently, such as between parts being spray coated. Alternatively, the powder and corona can be pulsed out-of-phase, for example, in intervals from under one second to several seconds. In other words, the powder flow can be periodically interrupted, and the corona applied during these interruptions. In this way, the tribocharging process can continue indefinitely since charge build up on the contact surfaces will not occur.

A second procedure is to treat the contact surfaces while the powder is flowing through the gun, but to use a lower voltage to continuously discharge the contact surfaces. In general, however, the voltage must be at least 30 KV to maintain a corona discharge. A third procedure is to pulse the corona at specific time intervals whether or not powder is flowing. These procedures will not result in excess ions which are detrimental to the coating since the majority of the ions will be used to discharge the contact surface and will not be used to charge the powder.

The corona pretreatment of the present invention should distinguished from conventional corona charging of powder. In corona charging, only about 0.5% of the ions are used to actually charge the powder (according to John Hughes, "Powder Coating Technology," *Journal of Electrostatics*, vol. 23, pp. 3–23, 1989). The remaining 99.5% of the ions are attracted to the part being spray coated, and these ions result in back-ionization. Back-ionization disrupts the coating operation by spark discharge and leads to an "orange peel" effect which is detrimental to the coating appearance. In addition, back-ionization at the part produces ions of opposite polarity which are attracted back to the gun and tend to discharge the incoming powder. With the present invention, excess free ions are not produced which may interfere with the appearance and integrity of the coating. The corona pretreatment is only used to pretreat the contact surfaces, and powder charging is produced triboelectrically by the contact of the powder with the contact surfaces. This eliminates the production of excess ions as is typical in corona charging.

Using the present invention, a corona is needed only to provide mobile gaseous ions to at least neutralize or provide ions of the correct polarity to charge the powder without generating substantial free ions out the gun. The voltage from the power supply 23 to the electrode 20 should be controlled to accomplish this. The maximum voltage required to maintain maximum powder chargeability with minimum formation of free ions should be established beforehand for any given application. When this voltage has been established, the ion formation is effective in treating the contact surfaces, and the production of excess free ions is avoided.

A sensor, such as the field mill 46, can be used to determine when to trigger the corona. When the field mill 46 senses a charge buildup on the surfaces of the charging portion 13 of the gun, it provides an indication to the controller 47, which triggers the power supply 23, and the electrode 20 automatically goes into corona at a preset voltage level and time. The field mill 46 is deactivated while the corona discharge occurs. After the corona has been turned off, the field mill 46 is again activated.

Unlike the prior art charging guns, the present invention does not require that the charging portion 13 of the gun be provided with a ground. In conventional tribocharging guns, an important element in the performance of triboelectric powder spray guns was the grounding of the powder flow path. Grounding was usually accomplished by providing a grounding path from the charging portion of the gun, and discharge of the contact surfaces was accomplished using surface discharge. As the concentration of charges built up on the contact surfaces to a certain level, the charges found the nearest ground to discharge this charge, and this discharge occurred through surface conduction to the grounding path built into the gun. If, however, this grounding was ineffective, and contact surfaces could not be effectively discharged, the tribocharging process could not effectively continue due to excess surface charge. Excess surface charge prevents the powder from becoming charged when making contact with the contact surface because it is more difficult for the powder particles to deposit electrons on or acquire electrons from a highly charged surface. Using the present invention, the grounding path is no longer required for the powder flow path since the corona pretreatment provides for discharging the contact surfaces. Furthermore, since the corona pretreatment using the electrode 20 provides the necessary positive or negative discharge of the contact surfaces at required intervals, an excess charge on the contact surfaces is prevented, and tribocharging can occur more efficiently.

The present invention uses an active corona electrode 20 instead of a ground to discharge the contact surfaces. According to the present invention, an active corona from the electrode without any ground reference internal to the gun is used to at least neutralize the charged contact surfaces. This is contrasted to guns having a passive corona electrode which normally is a grounded pointed electrode in the powder flow path. For that type of grounded electrode to become operable in discharging accumulated charge within a spray gun, sufficient charge must be allowed to accumulate within the spray gun to cause the grounded electrode to go into corona. That is because it is a passive corona electrode. With the active corona electrode of the present invention, however, it is not necessary to allow surface charge to build up to a threshold level before effective discharge of the surfaces can occur. This makes the active corona discharge electrode of the present invention more effective overall than a passive discharge electrode.

As one example of the teachings of the present invention if the contact surfaces are of a material, such as PTFE, which will charge the powder positively and leave the surface negatively charged, the surfaces would be treated with a positive corona, such as a +100 KV corona, to discharge the negative surface charge as it is produced. After the contact surfaces were treated with this positive corona, the powder would be able to continue to pick up positive charges from the surfaces. By contrast, if the positive charge on the surface was allowed to become depleted and was not replenished by the positive active corona electrode, a large negative charge would eventually develop on the contact surfaces. At that point the powder could no longer be effectively charged by the contact surfaces.

In addition to providing a more effective method for discharging the contact surfaces, the corona pretreatment can also increase the effectiveness of the initial tribocharging before the contact surfaces need to be discharged. The corona pretreatment deposits ions on the contact surfaces of the powder flow path, and these deposited ions are accepted by the powder during tribocharging in addition to the normal tribocharging effect. This effectively increases the charge on the powder, and thus increases the transfer efficiency. If the powder has a tendency to charge positively the pretreatment with a high positive voltage, e.g. +100 KV, will increase the transfer efficiency over the normal tribocharging level. As the pretreatment ions are used up, the transfer efficiency will slowly drop to the normal tribocharging level.

Other parts of the powder delivery system can be corona treated prior to conveying powder to be tribocharged. Alternatively, ions can be introduced upstream of the spray gun in the powder/air stream. These ions can be initiated in the powder/air stream or outside the powder/air stream such as in the air feed to the pump or the air feed to the fluidized bed. This early introduction of ions maximizes the interaction of the powder with the ions. Ions can also be introduced from a porous hose, for example.

The gun 10 shown in FIG. 1 is intended for use in an automatic spray coating system in which the gun is mounted in suitable automatic spraying means, such as those that are robotic controlled. The automatic spraying means controls the direction and operation of the gun. It should be understood, however, that the gun 10 of FIG. 1 can be suitably modified for use as a hand-held spray gun by the addition of suitable handle and trigger means. Of course, if the gun is modified for hand-held use, the gun would include suitable safety grounding means for the operator. These safety grounding means would not, however, provide a grounding path for the powder contact surfaces.

While the invention has been shown and described with reference to a triboelectric charging gun, the invention can be adapted for use in a corona charging gun having a spray nozzle which is contacted by the powder, such as a flat spray nozzle. In that case, the corona needle located inside the flat spray nozzle could be used to pretreat the inside contact surface, at −100 KV for example, for a few seconds prior to spraying. During spraying the voltage could then be decreased to less than −100 KV since, to apply powder most efficiently, the minimum voltage which achieves the highest transfer efficiency should be used. When the powder is not being sprayed, as for example between parts, the voltage supplied to the electrode which produces the corona can be temporarily increased then reduced while powder is fed through the gun.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way this is inconsistent with the extent to which the progress in the art has been advanced by the invention.

What is claimed is:

1. A method of electrostatic spraying of powder material comprising the steps of:

flowing the powder material through a spray gun;

using triboelectrification to charge the powder material to a first polarity in the spray gun by impacting the powder material with contact surfaces within the gun, while leaving the contact surfaces with a second polarity, the second polarity being opposite to the first polarity; and treating the contact surfaces with a corona of the first polarity, the corona being controlled to treat the contact surfaces without substantially charging the powder.

2. The method of electrostatic spraying of powder material as defined in claim 1, wherein the treating step is performed while powder is not flowing through the spray gun.

3. The method of electrostatic spraying of powder material, comprising the steps of:

flowing the powder material through a spray gun;

triboelectrically charging the powder material to a first polarity in the spray gun by impacting the powder material within the gun with contact surfaces , while leaving the contact surfaces with a second polarity, the second polarity being opposite to the first polarity;

treating the contact surfaces with a corona of the first polarity; and eliminating a necessity for a ground path for the contact surfaces.

4. The method of electrostatic spraying of powder material as defined in claim 3, wherein the treating step is performed while the powder is not flowing through the spray gun.

5. The method of electrostatic spraying of powder material , comprising the steps of:

providing a spray gun with contact surfaces and without an effective ground path from the contact surfaces;

flowing the powder material through the spray gun, the powder material impacting the contact surfaces to produce an electrostatic charge on the powder material;

treating the contact surfaces with a corona to discharge the contact surfaces;

sensing a buildup of charge on the contact surfaces; and initiating the treating step when the buildup exceeds a certain level.

6. The method of electrostatic spraying of powder material, comprising the steps of:

providing a spray gun with contact surfaces and without an effective ground path from the contact surfaces;

flowing the powder material through the spray gun, the powder material impacting the contact surfaces to produce an electrostatic charge on the powder material;

treating the contact surfaces with a corona to discharge the contact surfaces; and eliminating a necessity for a ground path for the contact surfaces through means for treating the contact surfaces with the corona.

7. A method of electrostatic spraying powder material comprising the steps of:

pretreating contact surfaces of a triboelectric spray gun with corona without flowing any powder material through the gun; and discontinuing the corona pretreatment, and spraying the powder material through the gun onto a workpiece.

8. A triboelectric powder spray gun, which comprises:

a feed portion for supplying powder to the gun and for mixing powder with a conveying gas;

a charging portion downstream of the feed portion, the charging portion including contact surfaces which triboelectrically charges the powder as it flows therethrough, substantially all of the charging of the powder being triboelectric, the contact surfaces each made of electrically insulating material with triboelectric charging properties, whereby the powder is frictionally charged by repeated contact with the contact surfaces;

an electrode for producing ions which are deposited on the contact surfaces to discharge the contact surfaces without substantially charging the powder; and a sprayhead at the outlet of the charging portion for dispensing the triboelectrically charged powder.

9. The triboelectric powder spray gun as defined in claim 8, wherein the contact surfaces are ungrounded.

10. The triboelectric powder spray gun, which comprises:

a feed portion for supplying powder to the gun and for mixing powder with a conveying gas;

a charging portion downstream of the feed portion, the charging portion including contact surfaces for triboelectrically charging the powder as it flows therethrough, the contact surfaces each made of electrically insulating material, whereby the powder is frictionally charged by repeated contact with the contact surfaces;

an electrode for producing ions deposited on the contact surfaces to discharge the contact surfaces;

a sprayhead at the outlet of the charging portion for dispensing the charged powder; and a sensor for sensing a buildup of charge on the contact surfaces.

11. The triboelectric powder spray gun as defined in claim 10, comprising in addition a controller connected to the sensor for actuating the electrode to produce ions when the sensor senses a buildup of charge on the contact surfaces.

* * * * *

UNITED STATES PATENT AND TRADEMARK OFFICE

CERTIFICATE OF CORRECTION

PATENT NO. : 5,622,313
DATED : April 22, 1997
INVENTOR(S) : Lader et al.

It is certified that error appears in the above-indentified patent and that said Letters Patent is hereby corrected as shown below:

Column 2, lines 3-4, "triboelecrically" should be —triboelectrically—.
Column 7, line 25, after "invention" should be inserted a comma — , —.
Column 8, line 34 ,after "material" should be inserted a comma — , —.

Signed and Sealed this

Twelfth Day of August, 1997

Bruce Lehman

*Attest:*

BRUCE LEHMAN

*Attesting Officer*

*Commissioner of Patents and Trademarks*